US010815710B2

(12) United States Patent
Svenson

(10) Patent No.: US 10,815,710 B2
(45) Date of Patent: Oct. 27, 2020

(54) HINGE ASSEMBLY FOR FOLDING CLOSURE

(71) Applicant: Dynamic Closures Corporation, Long Sault (CA)

(72) Inventor: Julian Michael Svenson, Martintown (CA)

(73) Assignee: DYNAMIC CLOSURES CORPORATION, Long Sault (CA)

( * ) Notice: Subject to any disclaimer, the term of this patent is extended or adjusted under 35 U.S.C. 154(b) by 191 days.

(21) Appl. No.: 15/998,086

(22) Filed: Jun. 29, 2018

(65) Prior Publication Data

US 2020/0002984 A1 Jan. 2, 2020

(51) Int. Cl.

| | |
|---|---|
| ***E06B 3/48*** | (2006.01) |
| ***E05D 1/04*** | (2006.01) |
| ***E05D 15/26*** | (2006.01) |

(52) U.S. Cl.

CPC ..... *E05D 1/04* (2013.01); *E05D 15/264* (2013.01); *E06B 3/481* (2013.01); *E05D 2015/268* (2013.01)

(58) Field of Classification Search

CPC ... E05D 1/04; E05D 15/264; E05D 2015/268; E05D 15/0634; E05D 15/26; E06B 3/481; E06B 3/482; E05Y 2900/142; Y10T 16/547

See application file for complete search history.

(56) References Cited

U.S. PATENT DOCUMENTS

| | | | | | |
|---|---|---|---|---|---|
| 3,148,724 | A * | 9/1964 | Chieger | B61D 19/006 | 160/40 |
| 3,405,756 | A * | 10/1968 | Harris | E06B 3/481 | 160/229.1 |
| 3,570,579 | A * | 3/1971 | Matsushima | A47B 17/04 | 160/235 |
| 4,081,881 | A * | 4/1978 | Lamarre | E05D 7/009 | 16/378 |
| 4,332,287 | A * | 6/1982 | Stolpe | E06B 9/11 | 160/133 |
| 4,660,613 | A * | 4/1987 | Dagenais | E05D 15/26 | 160/183 |
| 4,848,436 | A * | 7/1989 | Dagenais | E05D 15/26 | 160/199 |

(Continued)

*Primary Examiner* — Daniel P Cahn

(74) *Attorney, Agent, or Firm* — Cassan Maclean IP Agency Inc.

(57) ABSTRACT

A hinge assembly for a folding closure includes a plurality of elongated, planar panels, each of which has a pair of parallel sides, and flanges on each side with the flanges on one side extending in one direction perpendicular to a plane of the panel and the flanges on the other side extending in a second direction opposite to the one direction; and a hinge for pivotally connecting panels in side by side relationship to each other, the hinge including an elongated body having a generally triangular cross section, generally C-shaped grooves extending the length of the body proximate two adjacent corners of the body, the grooves opening in opposite directions for receiving the flanges of adjacent panels and permitting rotation of the panels about a longitudinal axis of the hinge between closure open and closed position, and opposed stops at the open outer ends of the grooves for limiting rotation of the panels between the open and closed position.

6 Claims, 8 Drawing Sheets

FIG. 2

(56) References Cited

U.S. PATENT DOCUMENTS 4,933,261 A 6/1990 Lyons
5,220,951 A * 6/1993 Dagenais ..... E05D 1/04 160/199
5,782,282 A * 7/1998 Chen ..... E05D 3/12 16/250
5,918,659 A * 7/1999 Lee ..... E06B 3/481 160/199
6,041,846 A * 3/2000 Langlois ..... B60J 5/14 16/267
6,223,804 B1 * 5/2001 Toti ..... E06B 9/36 16/355
8,579,008 B2 11/2013 Svenson
9,482,039 B1 * 11/2016 Xu ..... E05D 5/14
9,493,277 B2 11/2016 Svenson
9,995,073 B2 6/2018 Svenson
10,471,814 B1 * 11/2019 Weng ..... B60P 7/02
2006/0260768 A1 * 11/2006 Svenson ..... E05D 1/04 160/235
2007/0044926 A1 * 3/2007 Zuniga ..... E05D 3/12 160/183
2007/0163731 A1 * 7/2007 Zhong ..... E05D 15/26 160/206
2011/0259532 A1 * 10/2011 Smart ..... E05D 15/26 160/188
2012/0305201 A1 * 12/2012 Goodman ..... E05D 15/063 160/127
2014/0366321 A1 * 12/2014 Chen ..... E05D 15/26 16/225
2014/0367056 A1 * 12/2014 Miller ..... E05D 3/12 160/229.1
2015/0054300 A1 * 2/2015 Shi ..... B60R 11/00 296/100.09
2016/0060952 A1 * 3/2016 Prosperi ..... E06B 3/4636 160/196.1
2016/0245002 A1 8/2016 Svenson

* cited by examiner

HINGE ASSEMBLY FOR FOLDING CLOSURE

FIELD OF THE INVENTION

This invention relates to a hinge assembly for a folding closure.

More specifically, the invention relates to a hinge assembly for a closure formed of a plurality of elongated flat panels with side edges interconnected by hinges for forming a folding closure. The hinges are designed to pivotally interconnect the panels in a manner which permits rotation of the adjacent panels around vertical axes between a closed position and an open position in which the panels are folding together with the hinges abutting the plane of the closure in the closed position.

BACKGROUND OF THE INVENTION

Hinge assemblies for pivotally connect closure panels are not new. Examples of such assemblies are described in U.S. Pat. No. 3,570,579, issued to S. Matsushima on Mar. 16, 1971; U.S. Pat. No. 4,933,261, issued to D. Lyons on Jun. 12, 1990 and U.S. Pat. No. 8,579,008, issued to M. Svenson on Nov. 12, 2013. While the known hinge assemblies perform the same function as the assembly of the present invention, for the most part they are structurally complicated and are not always suited for connecting vertical panels.

SUMMARY OF THE INVENTION

An object of the present invention is to provide a relatively simple hinge assembly which permits folding of the closure to a compact open condition in which only one side of the hinges is visible from the outside of the opening in which the closure is mounted. The hinge assembly is also relatively frictionless, i.e., there is very little contact between the adjacent panels and the hinges, and no contact between the panels in the hinges.

In accordance with the present invention, the hinge assembly for a folding closure comprising a plurality of flat, elongated, planar panels, each panel having a pair of parallel sides; a first flange on one side of each panel extending in one direction perpendicular to a plane of the panel; a second flange on a second side of each panel extending in a second direction opposite to said one direction out of the plane of the panel; a hinge for pivotally connecting panels in side by side relationship to each other, the hinge including an elongated body having a triangular cross section; C-shaped grooves extending the length of the body proximate two adjacent corners of the body, the grooves opening in opposite directions for receiving the flanges of adjacent panels and permitting rotation of the panels around a longitudinal axis of the hinge between a closure open position in which the hinges abut each other at the front and rear of the closure; and opposed stops at the open outer ends of the grooves for limiting rotation of the panels between the open and closed positions.

BRIEF DESCRIPTION OF THE DRAWINGS

The invention is described below in greater detail with reference to the accompanying drawings which illustrate preferred embodiments of the invention, and wherein.

DETAILED DESCRIPTION OF THE INVENTION

Figure 1:
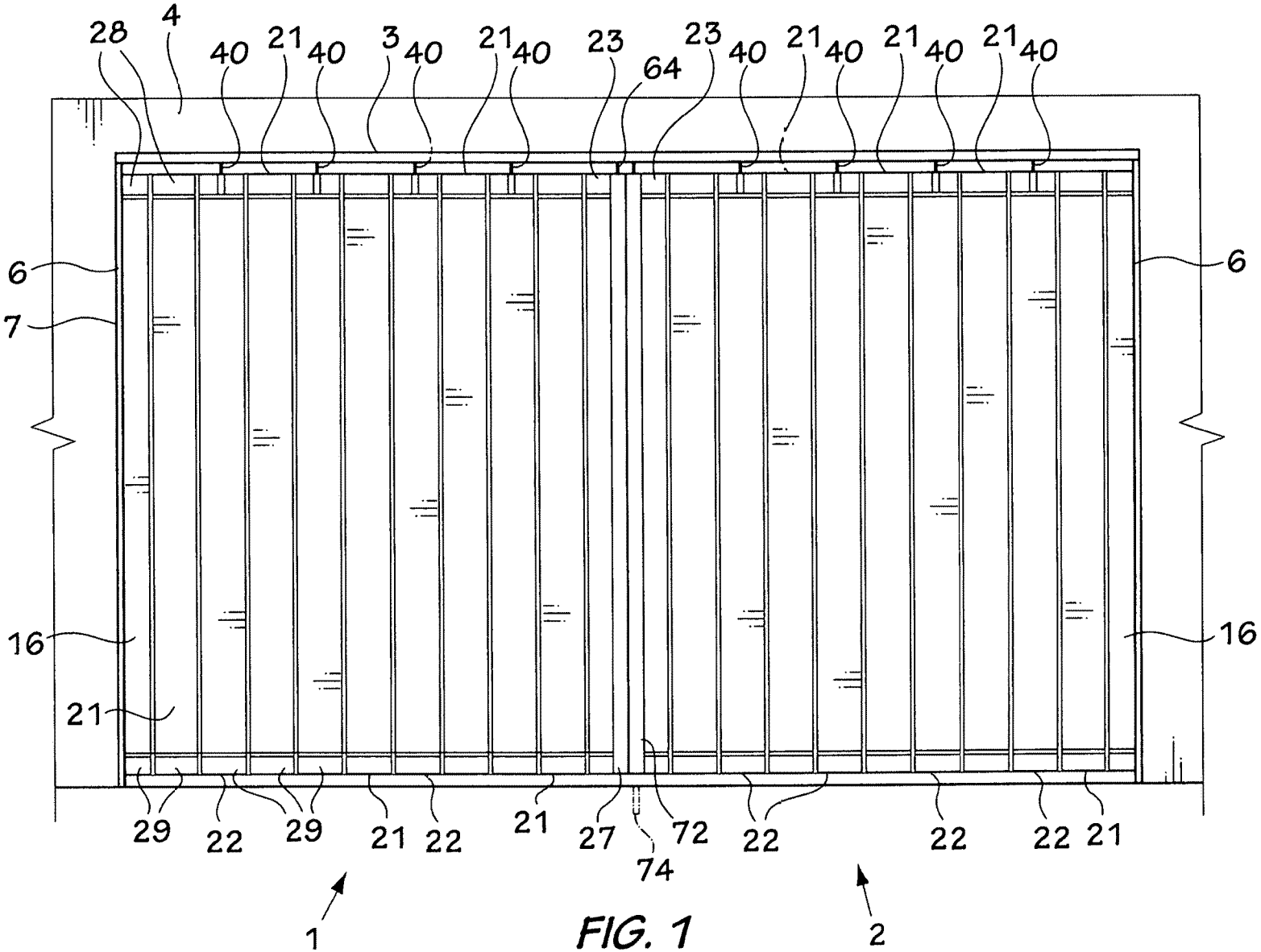
FIG. 1 is a schematic front view of a folding closure incorporating the hinge assembly of the present invention.
Figure 2:
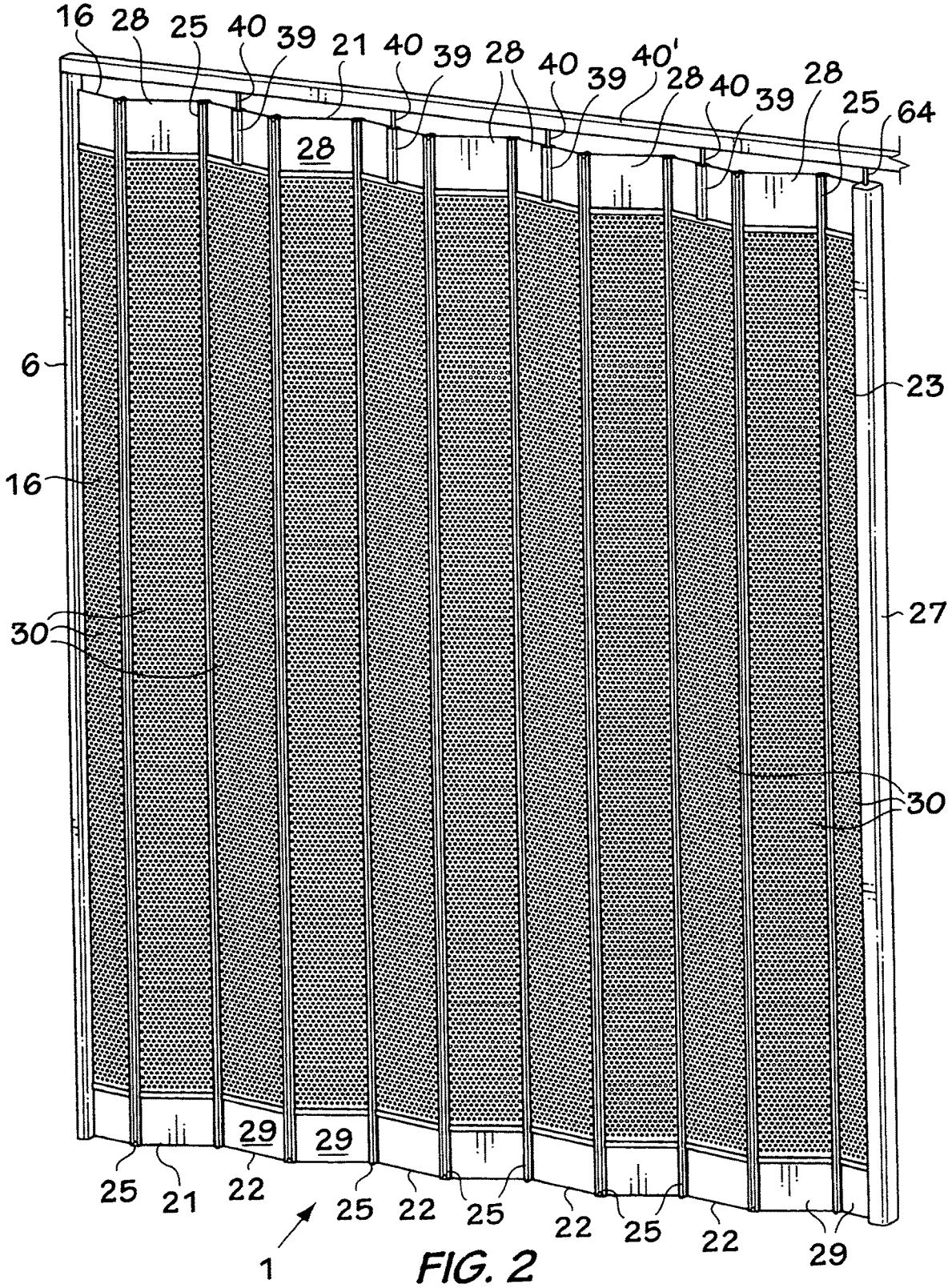
FIG. 2 is an isometric view of one section of the folding closure of FIG. 1.
Figure 3:
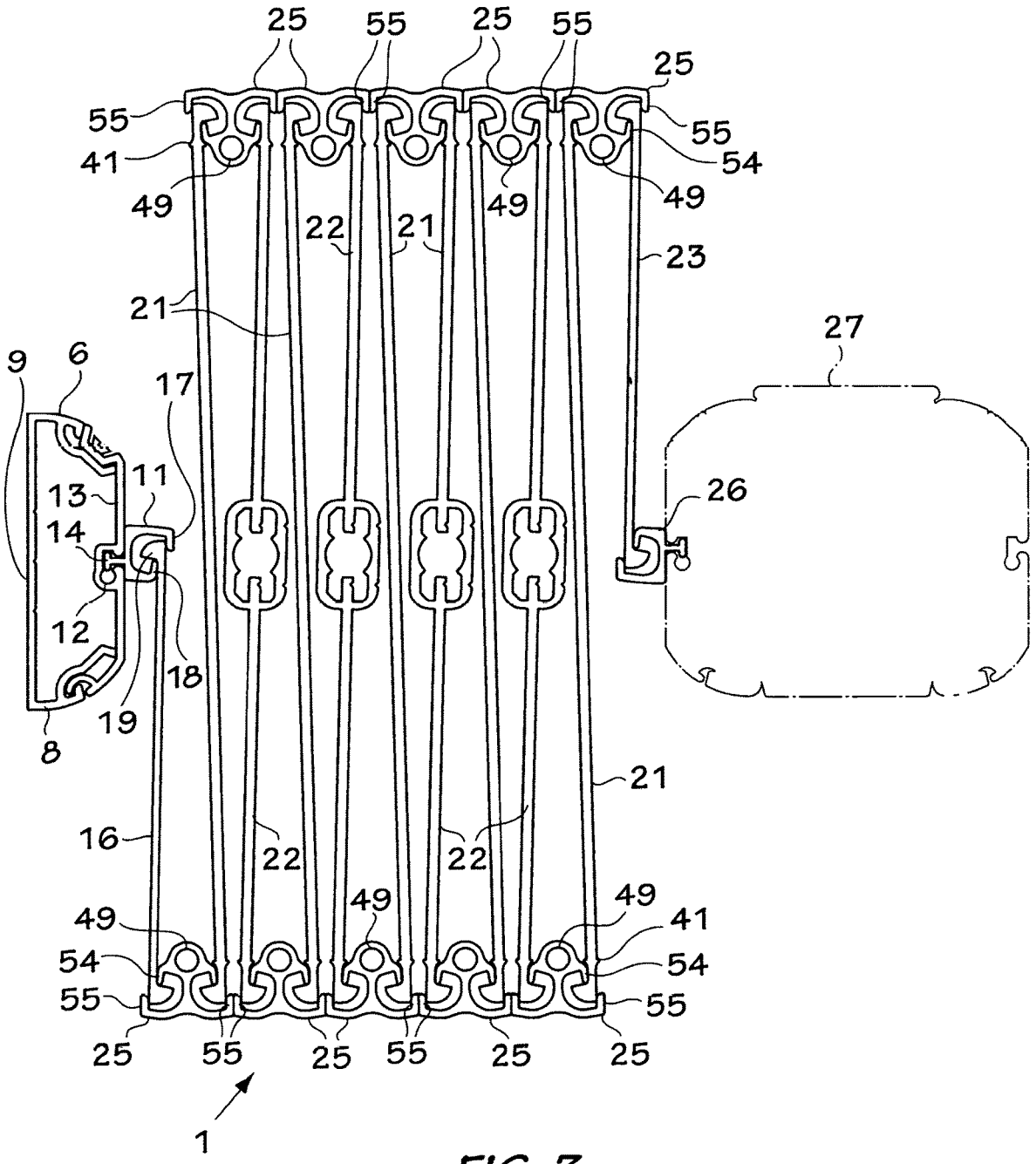
FIG. 3 is a top view of the section of the folding closure of FIG. 2.

With reference to FIGS. 1 to 3, a folding closure is formed of first and second sections indicated generally at 1 and 2, respectively, for closing an opening 3 in a wall 4 of a building. Depending upon the width of the opening 3, the closure can consist of only one section. One end of the first closure section 1 is pivotally connected to a post 6, which is mounted on one side 7 of the opening 3. The post 6 is similar in structure to one side of the locking post described in U.S. Pat. No. 9,493,277, issued to M. Svenson on Nov. 15, 2016 and in US Application No. 2016/0245002, filed by M. Svenson on Aug. 25, 2016. The post 6 (FIG. 3) includes a semi-cylindrical body 8 with a D-shaped cross-section. The straight side 9 of the body 8 is connected to the side 6 of the opening 3 by screws (not shown). A connector 11 with a generally C-shaped cross-section is mounted in a slot 12 in a second side 13 of the post 6. The slot 12 is generally T-shaped in cross-section for receiving a similarly shaped post 14 on one side of the connector 11. One side of a panel 16 is pivotally mounted in the connector 11. Rotation of the panel 16 is limited by opposed flanges 17 and 18 in the open side of the connector 11 for engaging a flange 19 on the side of the panel 16.

The post 6, connector 11 and the panel 16 form one end of the first closure section 1. The remainder of the closure section 1 is formed by a plurality of panels 21, 22 and 23 pivotally interconnected by hinges 25, a second connector 26 and a locking post 27 of the type described in the above-referenced US patent. The second connector 24 is identical to the connector 11. As best shown in FIG. 3, the end panels 16 and 23 are roughly one-half the width of the panels 21 and 22 so that when the closure section 1 is in the open position (FIG. 3) it forms a compact structure with the hinges 25 abutting each other.

Figure 4:
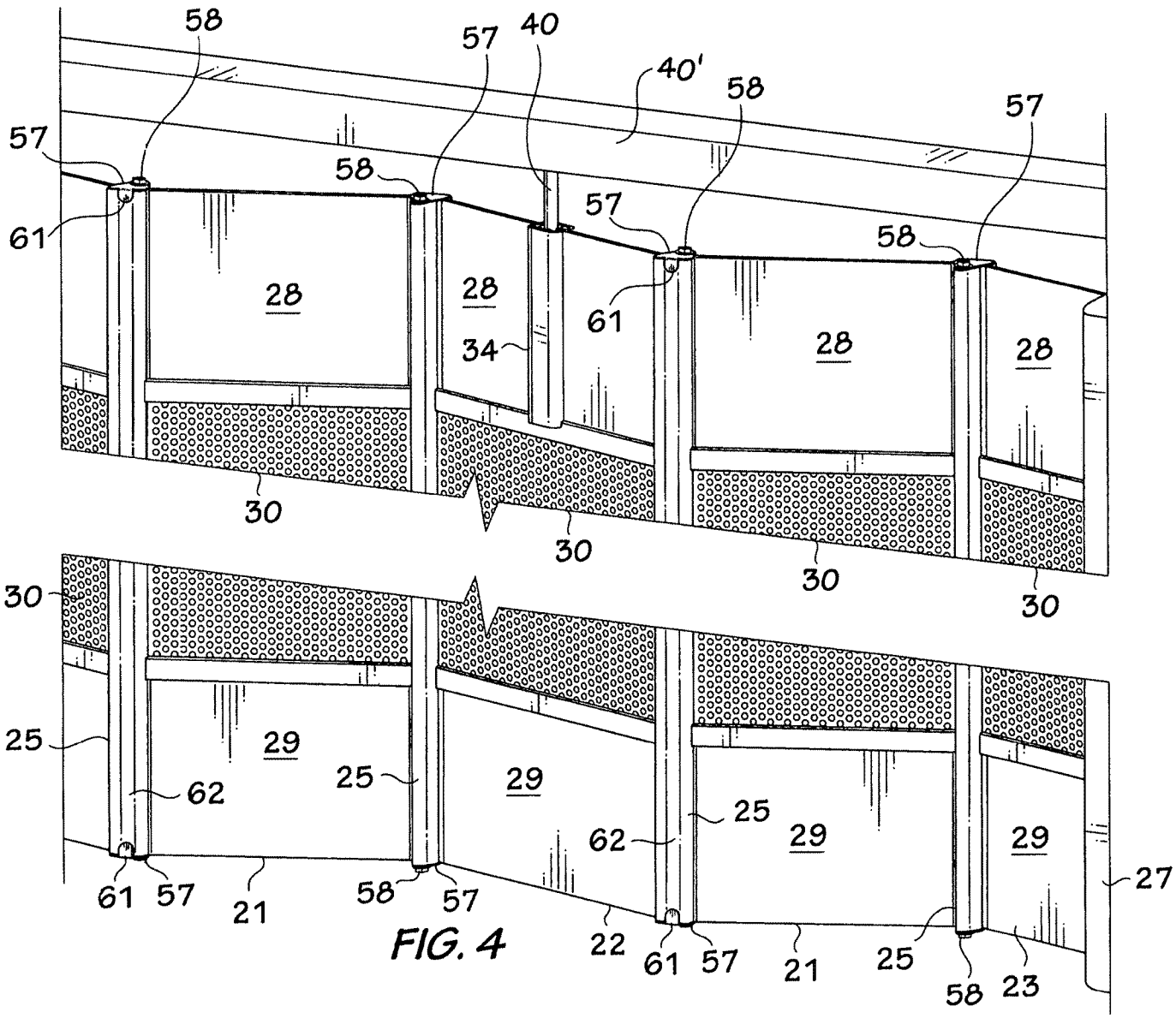
FIG. 4 is an isometric view of a portion of the folding closure section of FIG. 2 on a larger scale.
Figure 5:
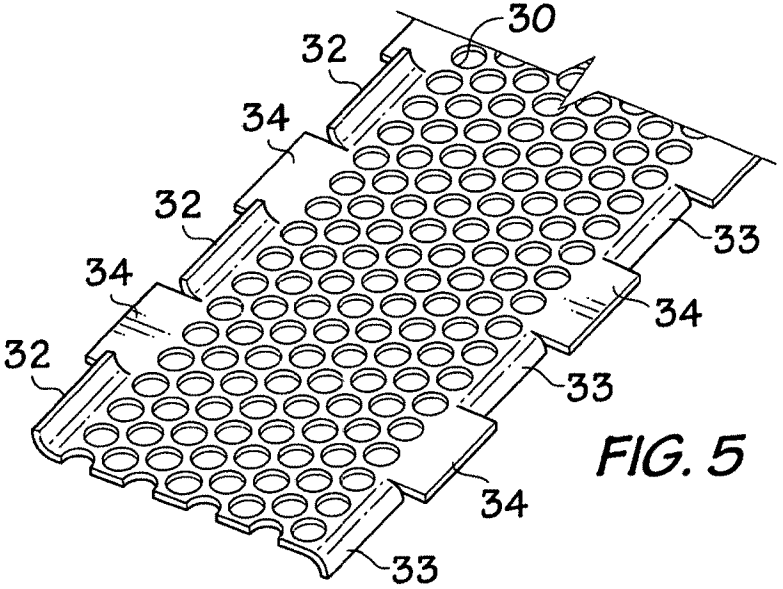
FIGS. 5 to 7 are isometric views of different panels used in the folding closure of FIG. 1.

As best shown in FIGS. 2 and 4, one embodiment of the panels 16, 21, 22 and 23 include top plates 28, bottom plates 29 and a metal mesh body 30 (FIG. 5) extending between the top and bottom plates. The panels 16, 21, 22, and 23 are planar with arcuate flanges 32 and 33 on one side of the panels 16 and 23, and on both sides of the panels 21 and 22. The flanges 32 and 33 are defined by spaced apart arcuate areas alternating with flat fingers 34, which are in the same plane as the body 30 of the panel. The flanges 32 and 33 extend outwardly from the plane of the panels in opposite directions.

Figure 6:
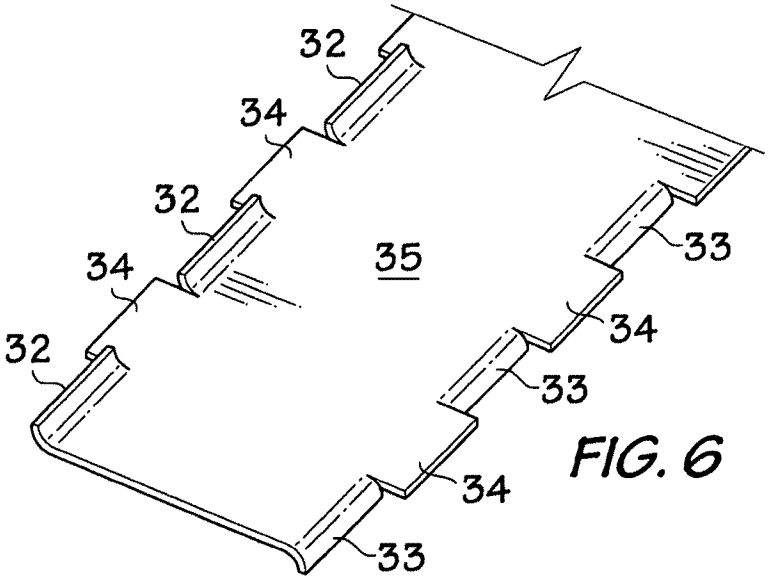
Figure 7:
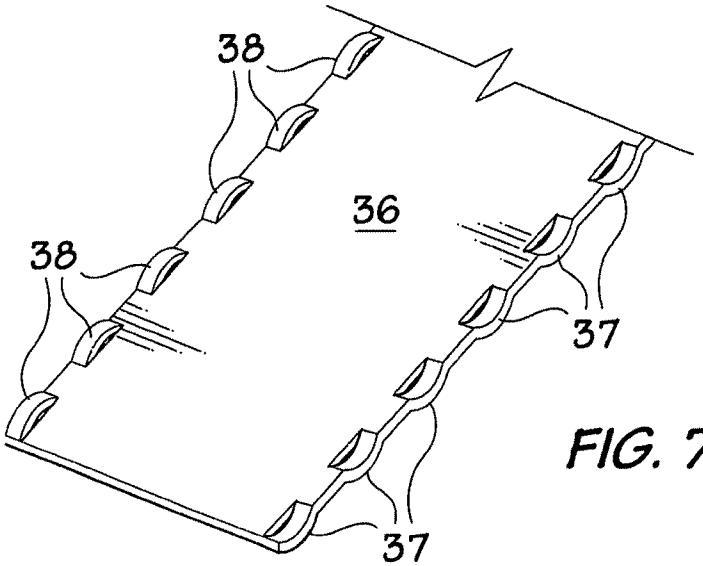

In other embodiments, the bodies of the panels 16, 21, 22 and 23 are solid extruded sheets 35 (FIG. 6) with flanges 32 and 33, or a solid body 36 (FIG. 7) with flanges formed by spaced apart, convex projections 37 and 38 on the side edges of the body 36 extending in opposite directions from the plane of the plate. The projections 37 and 38 can be produced using rollers (not shown) with spaced apart convex projections for deforming the side edges of the body 36.

Figure 8:
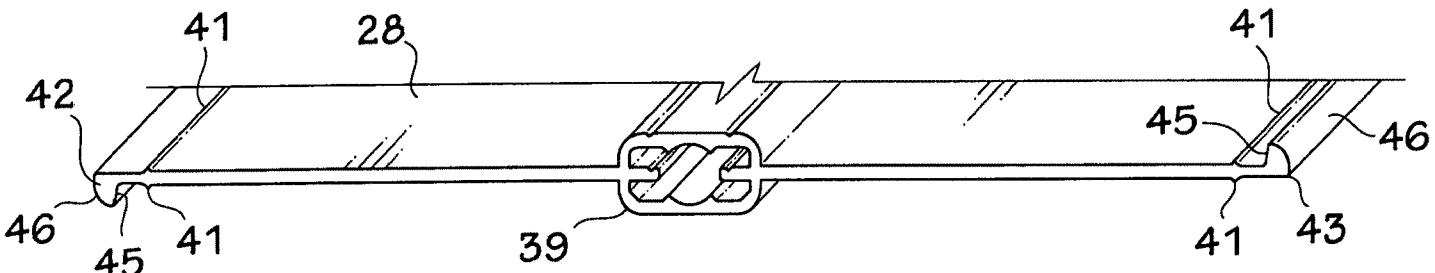
FIG. 8 is an isometric view of one end of a panel used in the closure section of FIG. 4.
Figure 9:
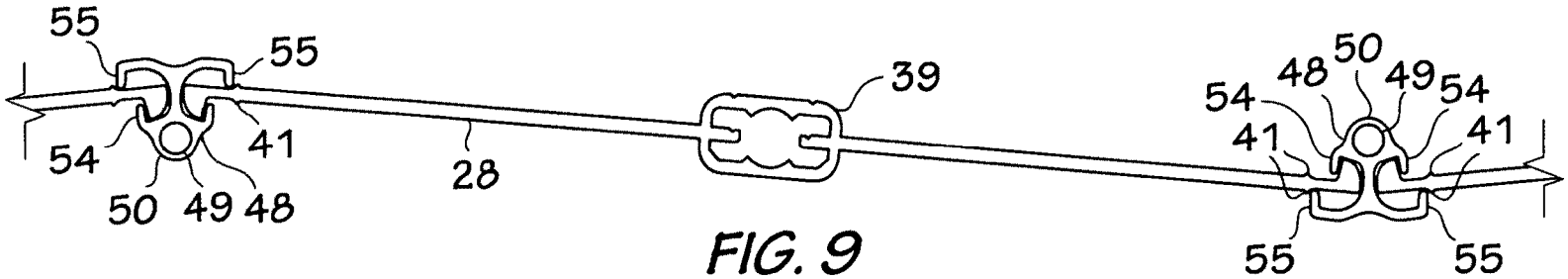
FIG. 9 is an end view of a panel interconnected by hinges.

As best shown in FIGS. 2, 8 and 9, the top plate 28 of each panel 22 include a longitudinally extending socket 39 for receiving a rod 40, which is used to suspend the panel 22 from a track 40' (FIGS. 2 and 3) as described in detail hereinafter. Each top and bottom plate 28 and 29 includes longitudinally extending projections 41 for limiting rotation of the panels relative to the hinges 25. The plates 28 and 29 are extruded aluminum with flanges 42 and 43 forming the side edges thereof. The flanges have straight inner sides 45 perpendicular to the plane of the plates 28 and 29, and convex outer sides 46 for rotation in the hinges 25.

Figure 10:
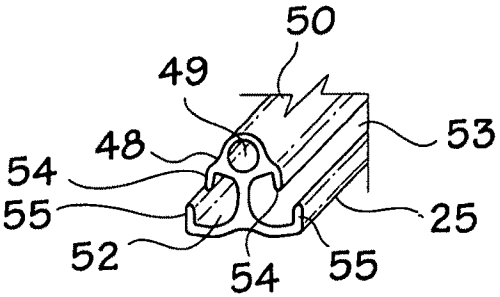
FIG. 10 is an isometric view of a hinge used in the hinge assembly.
Figure 11:
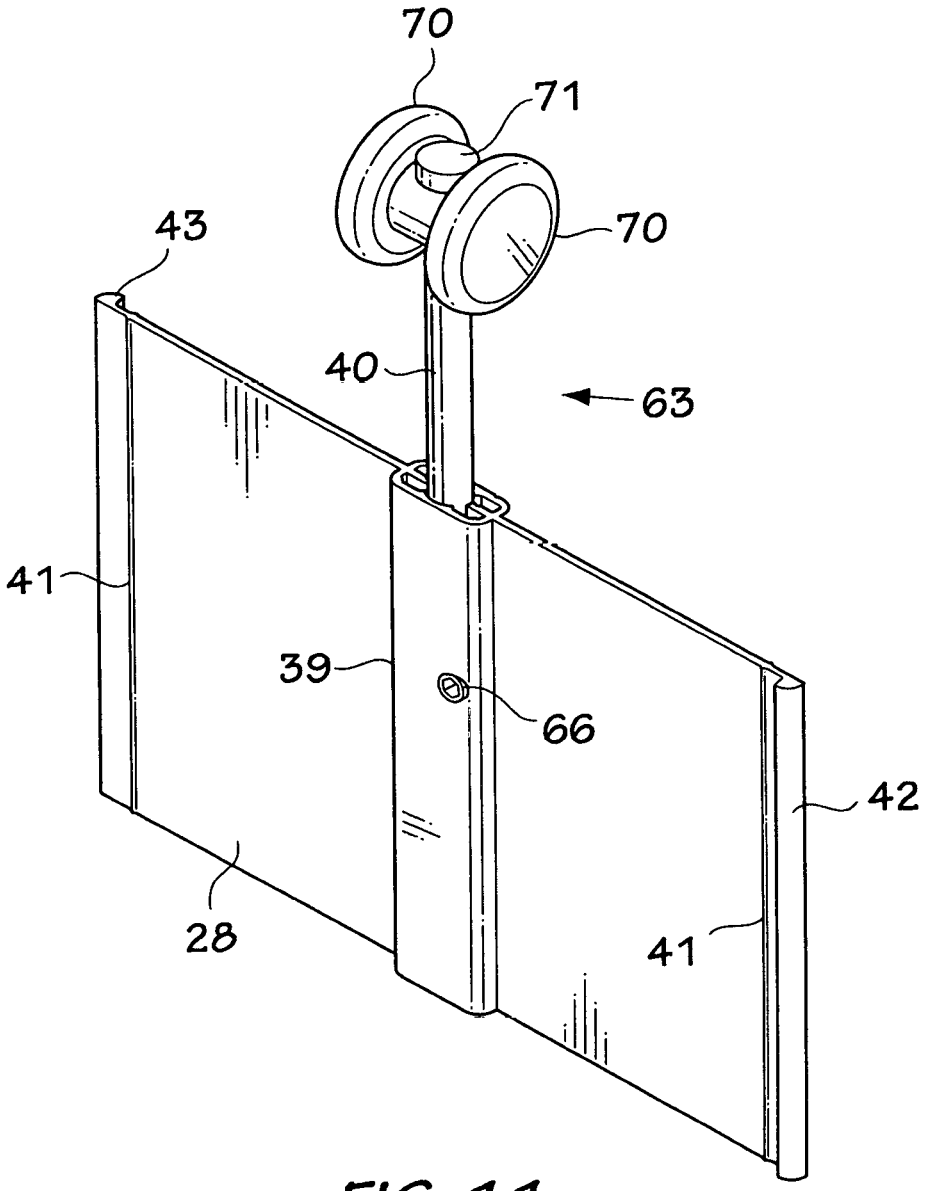
FIG. 11 is an isometric view of the top end of a panel and a roller assembly.
Figure 12:
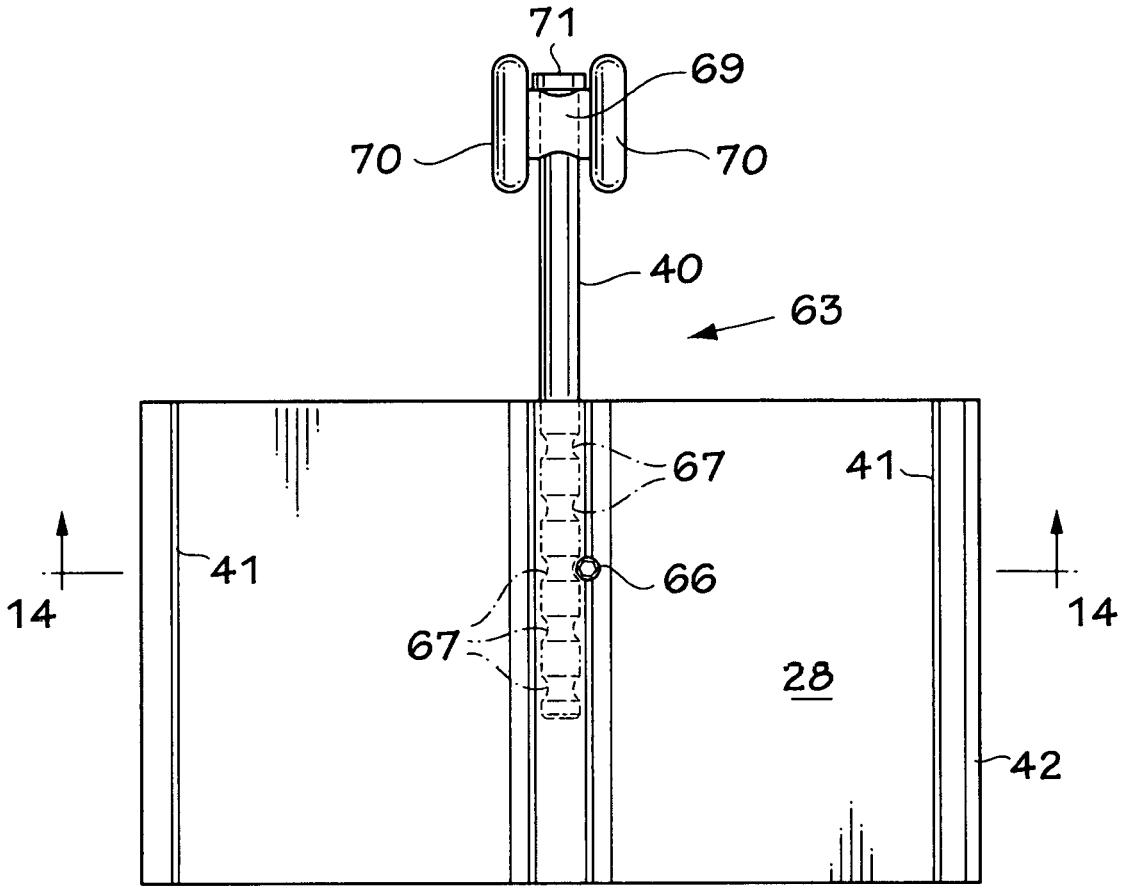
FIG. 12 is a side view of the roller assembly of FIG. 11.
Figure 13:
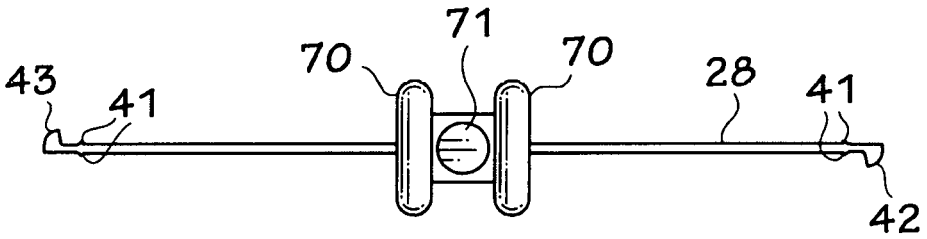
FIG. 13 is a top view of the roller assembly of FIG. 11.
Figure 14:
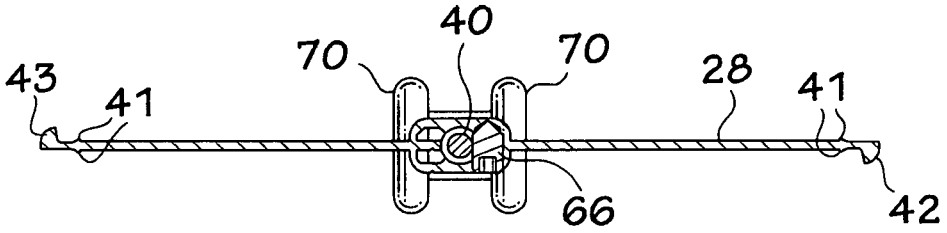
FIG. 14 is a cross section taken generally along line 14-14 of FIG. 12.

As best shown in FIGS. 3 and 10, each hinge 25 includes an elongated, extruded body 48 with a length slightly less than the length of the panels 16, 21, 22 and 23. The body 48 of the hinge 25 is generally triangular in cross-section. A hole 49 extends the length of the body 48 proximate a semi-cylindrical corner 50 of the body. Grooves 52 and 53 extend the length of the side of the body 48 proximate the second and third corners of the body for receiving the flanges 32 and 33 or 36 and 37 of adjacent panels 16, 21, 22 and 23, as well as the flanges 42 and 43 on the top and bottom plates 28 and 29, respectively. The grooves 52 and 53 are generally C-shaped in cross-section, and include opposed stops defined by flanges 54 and 55 at their open outer ends. The flanges 54 and 55 limit rotation of the panels 16, 21, 22 and 23 to a first position in which the closure is fully open (FIG. 3) and a second position in which the closure is fully closed (FIGS. 1 and 2). In the open position (FIG. 3), flanges 55 of the hinges 25 of one pair of panels 16 and 21, 21 and 22 or 21 and 23 abut each other. The result is the compact structure shown in FIG. 3. In the closed position of the closure sections 1 and 2, adjacent panels define the sides of angles alternately slightly less than 180° and slightly more than 180° (FIGS. 2 and 4).

When assembling the closure section 1, the flanges 32 and 33 or 37 and 38, and 42 and 43 are slid into the grooves 52 and 53 in the hinges 25. The panels 16, 21, 22 and 23 are retained in the hinges 25 by generally triangular end caps 57 and screws 58 which extend through holes 59 in the caps 57 into the holes 49 in the hinges 25. The shape of the caps 57 roughly match the shape of the ends of the hinges 25. A finger 61 perpendicular to the cap body extends to a concave groove 62 extending the length of the hinge body for preventing rotation of the caps 57 relative to the hinges 25.

The closure section 1 is suspended from the track 30 by a trolley (not shown) of the type described in U.S. Pat. No. 9,995,073, issued to M. Svenson on Jun. 12, 2018, and by roller assemblies indicated generally at 63 (FIGS. 12 to 15). The stem 64 (FIGS. 1, 2 and 4) of the trolley extends downwardly from a slot (not shown) in the bottom end of the track 30 and is securely mounted in the top end of the locking post 27. Each roller assembly 63 includes the rod 40 mounted in the socket 39 in the top plate 28 of each panel 22. The rod 40 is maintained in the socket 39 by a set screw 66 extending through one side of the socket 39 into one of a plurality of annular, concave grooves 67 in the rod 40. The annular grooves 67 permit vertical adjustment of the interconnected panels 16, 21, 22 and 23 relative to an uneven floor.

The rod 40 extends upwardly though an axle 69 carrying rollers 70 in the track 30. A head 71 on the rod 40 prevents downward movement of the rod 50 in the axle 69.

Referring again to FIG. 1, the second closure section 2 is virtually identical to the first section 1. Accordingly, the same reference numbers have been used to identify the same elements. In addition to the post 6, the panels 21, 22 and 23, the second section includes a second locking post 72 with the stem 73 of a trolley (not shown) extending out of the top thereof and a bolt 74 slidable in the bottom end thereof for extending into a hole in the floor of the building. In the closed position, the bolt 74 locks the section 2 to the floor of the building, and the section 1 is then locked to the section 2.

The invention claimed is:

1. A hinge assembly for a folding closure comprising a plurality of panels, each of said panels having an elongated, planar body with a pair of parallel sides, said hinge assembly comprising:

a first flange on one side of each of said panels extending in one direction perpendicular to a plane of each of said panels;

a second flange on a second side of each of said panels extending in a second direction opposite to said one direction out of the plane of each of said panels; and a hinge for pivotally connecting each of said panels in side by side relationship to each other, the hinge including an elongated hinge body having a generally triangular cross section, C-shaped grooves extending a length of the elongated body proximate two adjacent corners of the elongated body, the grooves opening in opposite directions for receiving the flanges of adjacent of said panels and permitting rotation of the panels around a longitudinal axis of the hinge between a closure open position in which two or more of the hinges abut each other at a front and a rear of the closure, and opposed stops at open outer ends of the grooves for limiting rotation of the panels between the open position and a closed position, wherein the first and second flanges include spaced apart arcuate areas on each of the parallel sides of the panels alternating with flat fingers which are coplanar with each of said panels.

2. The hinge assembly of claim 1, wherein the body of each panel is a solid sheet of material.

3. The hinge assembly of claim 1, wherein the body of each of said panels is a metal mesh.

4. The hinge assembly of claim 1, wherein the body of each of said panels is a solid sheet of material.

5. The hinge assembly of claim 1, wherein each of said panels includes solid, planar top and bottom plates; third flanges on one side of the top and bottom plates aligned with said first flanges and extending outwardly in said one direction; and fourth flanges on a second side of the top and bottom plates aligned with said second flanges and extending outwardly in said second direction.

6. The hinge assembly of claim 1 including a hole extending the length of the elongated hinge body proximate a third corner of the elongated hinge body; and a cap on each end of the elongated hinge body for covering ends of the grooves to retain the flanges of adjacent panels in the elongated hinge body.

* * * * *